US006749258B1

(12) United States Patent
Leikin

(10) Patent No.: US 6,749,258 B1
(45) Date of Patent: Jun. 15, 2004

(54) SEAT BOOT WITH COVER

(75) Inventor: Terri Leikin, Solon, OH (US)

(73) Assignee: Evenflo Company, Inc., Vandalia, OH (US)

( * ) Notice: Subject to any disclaimer, the term of this patent is extended or adjusted under 35 U.S.C. 154(b) by 0 days.

(21) Appl. No.: 10/367,493

(22) Filed: Feb. 14, 2003

(51) Int. Cl.[7] ..... A47C 31/00
(52) U.S. Cl. ..... 297/219.12
(58) Field of Search ..... 297/219.12, 219.1, 297/224, 228.11, 184.13, 184.11, 184.1; 2/69.5; 5/494

(56) References Cited

U.S. PATENT DOCUMENTS

| | | | | |
|---|---|---|---|---|
| 1,951,604 | A | | 3/1934 | Friedlander |
| 2,464,866 | A | | 3/1949 | Holtz |
| 2,486,067 | A | | 10/1949 | Schroeder |
| 2,707,988 | A | * | 5/1955 | Shaub et al. |
| 2,958,084 | A | | 11/1960 | Kenney |
| 3,580,633 | A | * | 5/1971 | Du Priest |
| 4,296,162 | A | | 10/1981 | Jean |
| D285,880 | S | | 9/1986 | Griesenbeck |
| 4,766,918 | A | | 8/1988 | Odekirk |
| 4,790,340 | A | | 12/1988 | Mahoney |
| 4,811,437 | A | | 3/1989 | Dillner et al. |
| 4,852,598 | A | | 8/1989 | Griesenbeck |
| D304,523 | S | | 11/1989 | Dillner et al. |
| 4,945,584 | A | | 8/1990 | LaMantia |
| 4,946,221 | A | | 8/1990 | Livingston |
| 5,046,204 | A | | 9/1991 | Mohler |
| 5,150,945 | A | * | 9/1992 | Aupperlee et al. |
| 5,163,191 | A | | 11/1992 | Chan |
| 5,170,826 | A | | 12/1992 | Carstensen et al. |
| 5,212,841 | A | | 5/1993 | Binnersley |
| 5,243,724 | A | | 9/1993 | Barnes |
| 5,309,586 | A | | 5/1994 | Sies et al. |
| 5,339,470 | A | | 8/1994 | Shamie |
| 5,432,965 | A | | 7/1995 | Espinoza |
| 5,437,061 | A | | 8/1995 | Kenner |
| 5,560,055 | A | | 10/1996 | Ziegler |
| 5,609,279 | A | | 3/1997 | O'Shea |
| 5,735,004 | A | | 4/1998 | Wooten et al. |
| 5,781,946 | A | | 7/1998 | McEntire et al. |
| 5,916,828 | A | | 6/1999 | Messner |
| 5,950,261 | A | * | 9/1999 | Hay et al. |
| 5,970,542 | A | * | 10/1999 | Mays |
| 5,988,742 | A | | 11/1999 | Stevens |
| 6,012,189 | A | | 1/2000 | Dudley |
| 6,019,421 | A | | 2/2000 | Roh |
| 6,036,260 | A | | 3/2000 | Mullen |
| 6,056,355 | A | | 5/2000 | Klassen |
| 6,145,932 | A | * | 11/2000 | Hamel-Nyhus et al. |
| 6,209,953 | B1 | | 4/2001 | Mackay et al. |
| 6,237,998 | B1 | * | 5/2001 | Aprile |
| 6,428,098 | B1 | * | 8/2002 | Allbaugh |

OTHER PUBLICATIONS

Cosco, Inc. website brochure for Eddie Bauer titled "Three Car Seats in One," (date unknown). Applicants admit the status of this publication as prior art for the limited purpose of examination of this application and reserve the right to challenge the status of this publication as prior art.

(List continued on next page.)

*Primary Examiner*—Milton Nelson, Jr.
(74) *Attorney, Agent, or Firm*—Taft, Stettinius & Hollister LLP

(57) ABSTRACT

An infant or child seat boot including a main portion shaped to be removably coupled to the seat bottom of an infant or child seat to define a space therebetween for receiving the legs of an occupant. The boot further includes a cover movable between a retracted position wherein said cover is generally received in the main portion and an extended position wherein the cover generally extends outwardly from the main portion.

17 Claims, 7 Drawing Sheets

OTHER PUBLICATIONS

Childrens Furniture website brochure entitled "Great Beginnings," (date unknown). Applicants admit the status of this publication as prior art for the limited purpose of examination of this application and reserve the right to challenge the status of this publication as prior art.

Strollers 4 Less website brochure for products, (date unknown). Applicants admit the status of this publication as prior art for the limited purpose of examination of this application and reserve the right to challenge the status of this publication as prior art.

* cited by examiner

SEAT BOOT WITH COVER

BACKGROUND

Infant seats, such as infant carriers and the like, are widely used to provide a convenient means for seating or transporting infants and children. Such infant seats typically include a seat back and a seat bottom in order to support an occupant thereon. A seat boot may be used to partially cover an occupant located on the infant seat in order to provide warmth to the occupant.

SUMMARY

In one embodiment, the present invention is a seat boot having a cover to provide additional warmth or cover to the occupant. The boot may include a pocket for storing the cover therein such that the cover is movable between an extended and retracted position.

In one embodiment, the invention is an infant or child seat boot including a main portion shaped to be removably coupled to the seat bottom of an infant or child seat to define a space therebetween for receiving the legs of an occupant. The boot further includes a cover movable between a retracted position wherein said cover is generally received in the main portion and an extended position wherein the cover generally extends outwardly from the main portion. Other objects and advantages of the present invention will be apparent from the following description and accompanying drawings.

DETAILED DESCRIPTION

Figure 1:
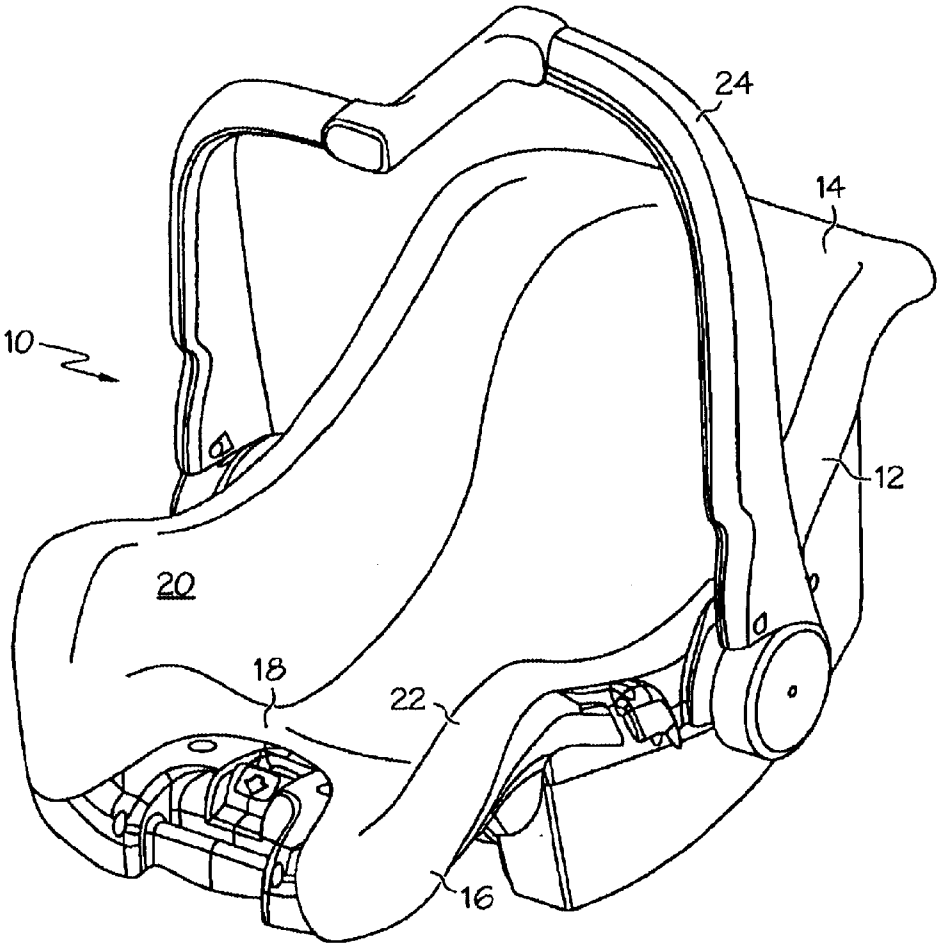
FIG. 1 is a top perspective view of an infant seat.

As shown in FIG. 1, an infant carrier or infant seat 10 may include a seat portion 12 having a seat back 14 and a seat bottom 16. The seat bottom 16 may include a seat pan 18 and a pair of opposed armrests 20, 22 extending generally upwardly from the seat pan 18. The infant seat 10 may include a plurality of belts, buckles restraining systems and the like (not shown) that can be used to securely retain an infant or child in the infant seat 10. The infant seat 10 may have a handle 24 so that an adult can grip the handle 24 and carry the seat 10 and occupant.

The infant seat 10 may be shaped to be releasably coupled to a vehicle, a car seat base, stroller, high chair frame, etc. Further, although FIG. 1 illustrates the infant seat 10 as an infant carrier, it should be understood that the boot of the present invention can be used with nearly any seat which can receive an occupant therein, such as a car seat, high chair, swing, bouncy chair, backpack, front carrier etc.

Furthermore, the boot is not restricted to use with infant seats, and may also be used with a variety of other seats, including toddler or juvenile seats.

Figure 2:
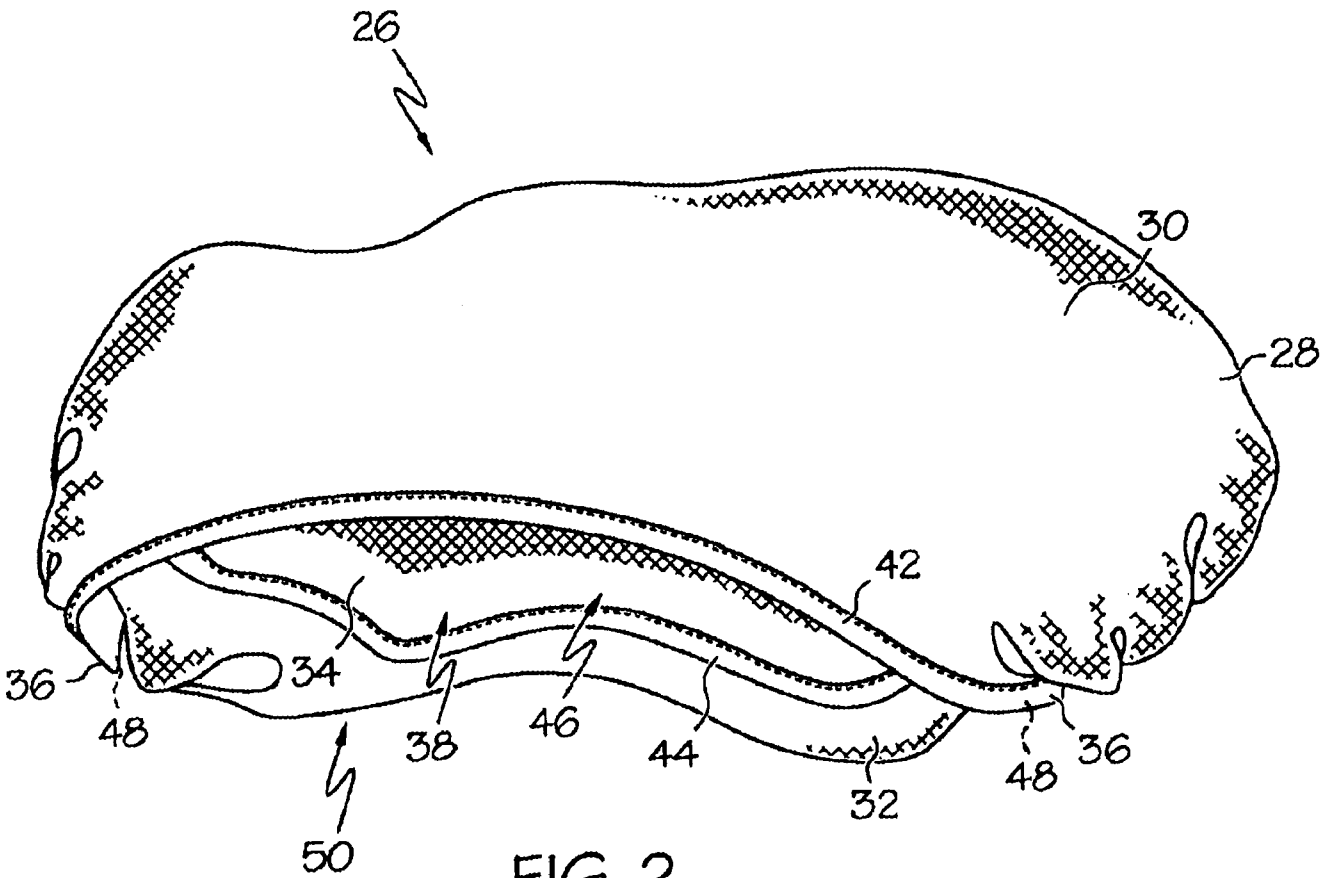
FIG. 2 is a front perspective view of one embodiment of the boot of the present invention, shown with the cover in its retracted position.

As shown in FIG. 2, the boot 26 may include a cover 34 and a main portion 28 which includes a top portion 30 and a bottom portion 32. The top portion 30 and bottom portion 32 may be similarly sized and shaped, and may be coupled together, such as along a portion of their common perimeters or outer edges 36 to form a pocket 38 therebetween. The top 30 and bottom 32 portions may be coupled together by a variety of methods, such as stitching. In the illustrated embodiment, top 30 and bottom portions 32 are not be coupled together along their free edges 42, 44 to define a mouth opening 46 therebetween which provides access to the pocket 38. In this manner, the top 30 and bottom 32 portions form the pocket 38 therebetween, with the pocket 38 having the mouth opening 46 formed between the free edges 42,44 of the top 30 and bottom 32 portions. As will be discussed below the cover 34 may be located inside the pocket 38.

Figure 7:
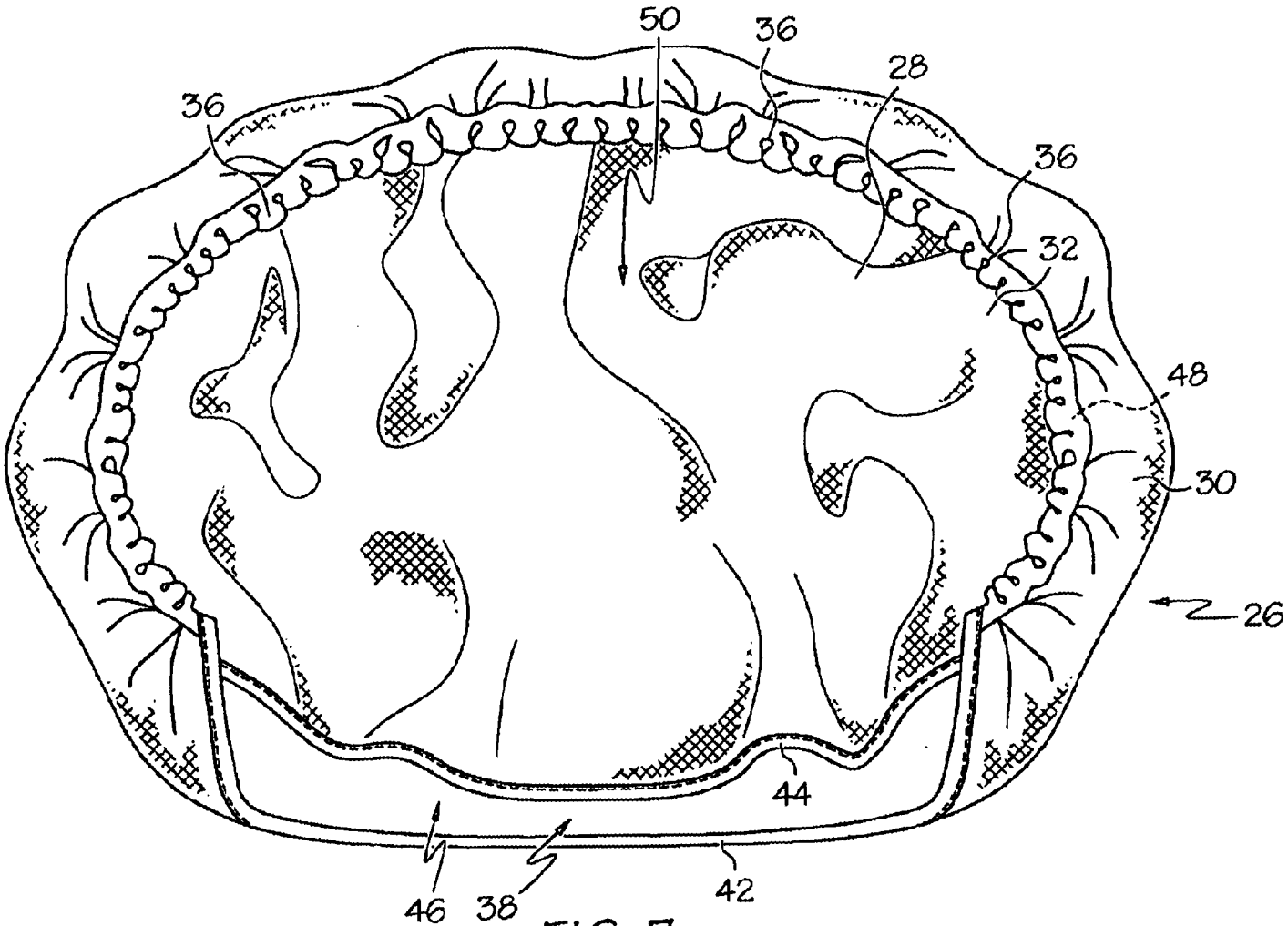
FIG. 7 is a bottom view of the boot of FIG. 2.
Figure 8:
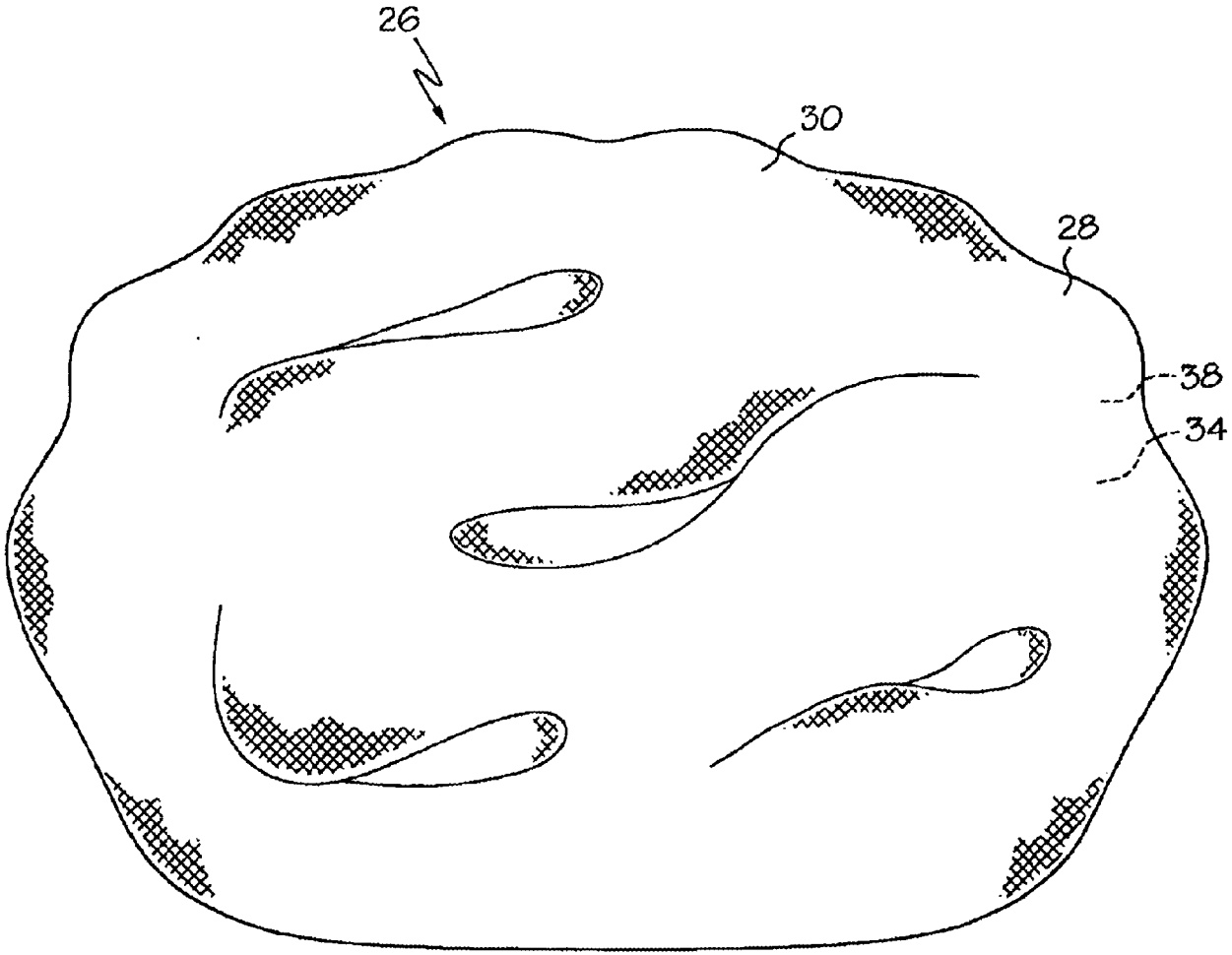
FIG. 8 is a top view of the boot of FIG. 2.

The top 30 and bottom portions 32 may be formed or made from a variety of materials, such as cottons, polyesters, polycotton, blends or nearly any fabric or other desired material. The boot 10 may include an elastic material 48 (such as an elastic cord) stitched along joined common edges 36 of the top 30 and bottom 32 portions. As shown in FIG. 7, the elastic material 48 may gather the common edges 36 inwardly in order to form a bottom opening 50 of variable size. Thus, as shown in FIG. 7, the boot 26 may have somewhat of a "shower cap" shape in bottom view, and a similar functionality with the bottom opening 50 being analogous to the space in which a person's head is inserted in a shower cap.

Figure 3:
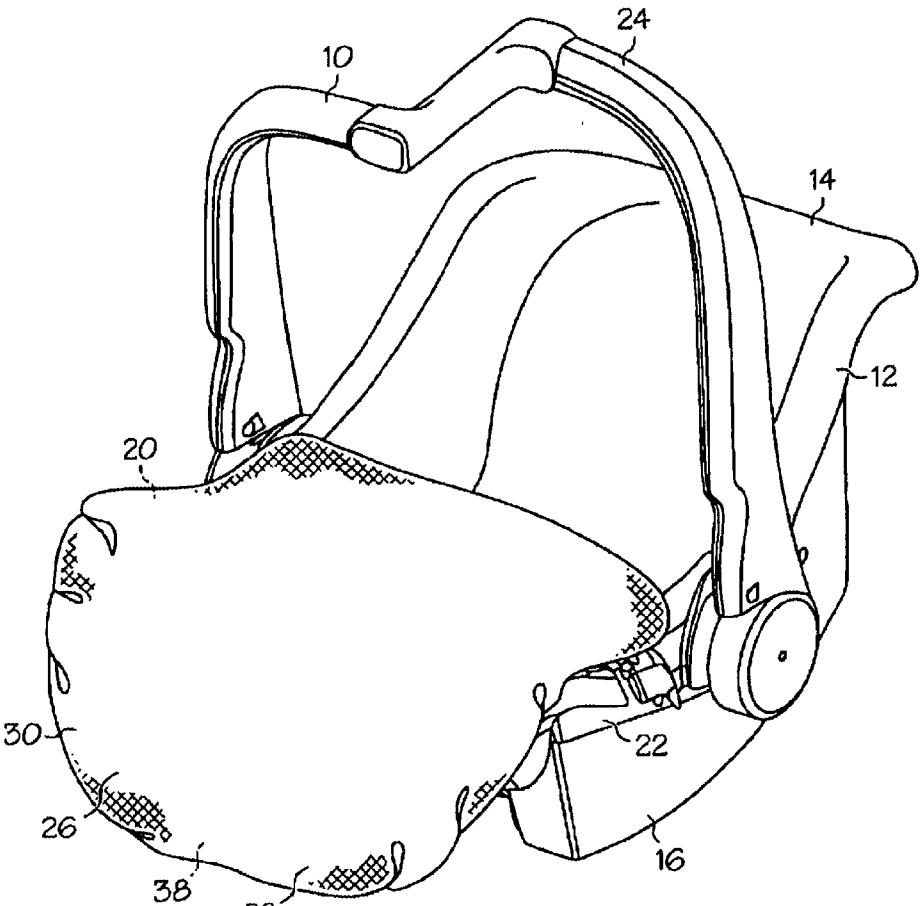
FIG. 3 is a perspective view of the boot of FIG. 2 mounted on the infant seat of FIG. 1.
Figure 4:
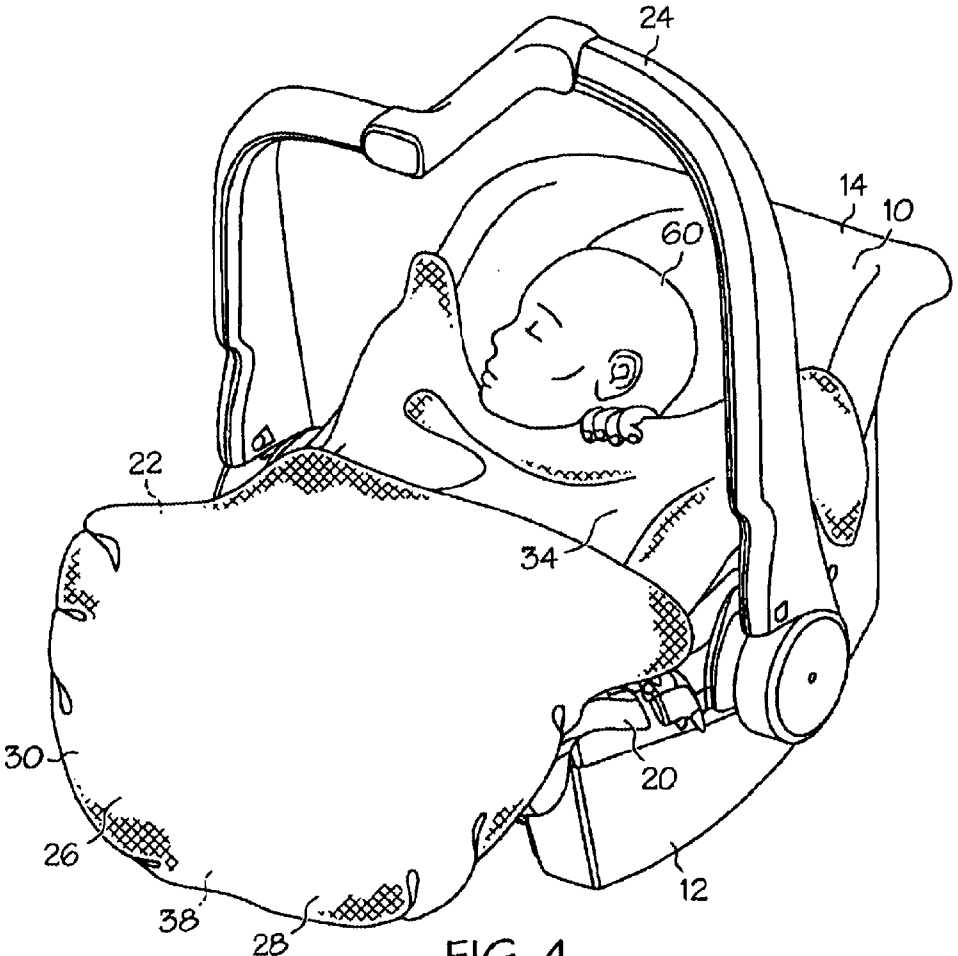
FIG. 4 is a perspective view of the boot and infant seat of FIG. 3, with the cover in its extended position.
Figure 6:
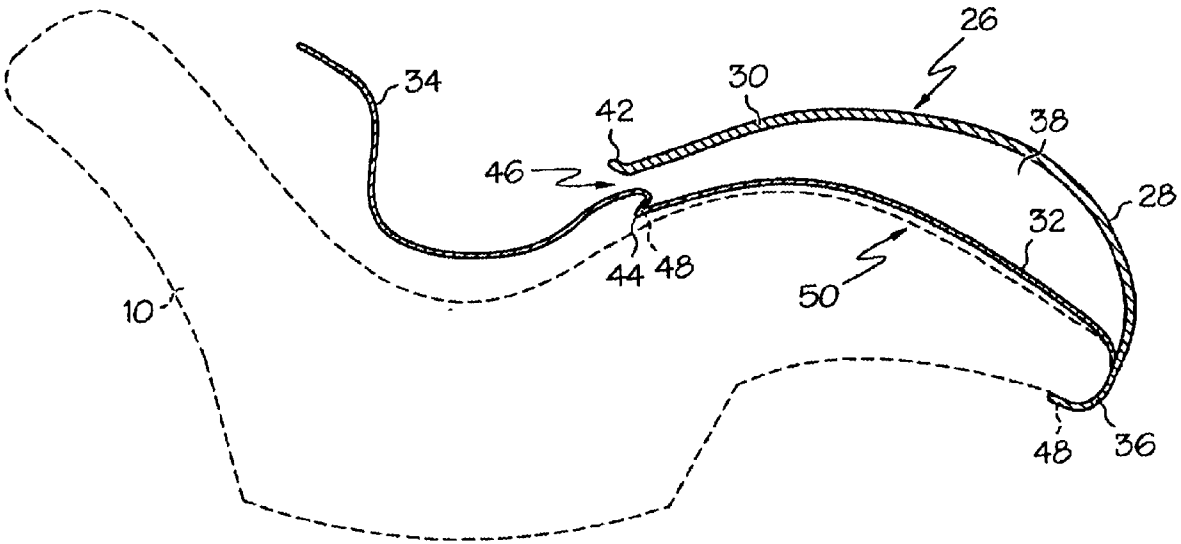
FIG. 6 is a side cross section of the boot and infant seat of FIG. 3, with the cover in its extended position and the infant seat shown in hidden lines.

As shown in FIGS. 3, 4 and 6, the boot 26 may be shaped to be removably coupled to the seat bottom 16 of the infant seat 10 such that the legs of the occupant may be located in the space defined between the boot 26 and the seat pan 18. In order to couple the boot 26 to the infant seat 10, the lower opening 50 may be expanded (i.e., by stretching the elastic material 48 or fitting the elastic material 48 over the armrests 20, 22) and the lower portion 32 may be slipped over the armrests 20, 22 of the infant seat 10. The user can then release the boot 26, and the elastic material 48 constricts around and grips the seat bottom 16 of the infant seat 10 to retain the boot 26 on the infant seat 10. Thus, the elastic material 48 is preferably shaped such that in its unexpanded state (FIG. 7) the lower opening 50 is smaller than the perimeter of the seat bottom 16 or arm rests 20, 22. The elastic material 48 is preferably sufficiently flexible that the elastic material 48 can be fit over the armrests 20, 22 and seat bottom 16 and the lower opening 50 can receive the armrests 20, 22 and seat bottom 16 therein to mount the boot 26 unto the seat 10.

The boot 26 may be able to be coupled to the infant seat 10 by a wide variety of means and methods beyond the elastic material 48 described above. For example, the lower opening 50 may not necessarily include the elastic material 48, and may be sized to closely fit over the infant seat 10 by simply stretching the fabric or other materials of the boot over the seat 10. Furthermore, any of a wide variety of attachment methods or methods may be used to attach the boot 26 to the infant seat 10 without departing from the scope of the present invention, including but not limited to hook and loop fastening systems, buttons, snaps, clasps, straps, brackets, clips, and the like.

The cover 34 may be bunched up or stored inside the pocket 38, and may be at least partially fixedly coupled to the major portion 28, such as by stitching. The cover 34 can be coupled to the main portion 28 of the boot 26 at nearly any location thereof In the illustrated embodiment, the cover 34 is coupled to the free edge 44 of the lower portion 32 (see FIG. 6). However, the cover 34 may be coupled to either the upper portion 30 or lower portion 32 at nearly any location thereof. The cover 34 may be made of a relatively thick insulating material (such as a blanket-like or woven material), but the cover 34 may also be made of or include nearly any desired material, such as fabrics (including the fabrics listed above for the top 30 and bottom 32 portions), plastics (i.e., to protect from wind or rain), mesh (i.e., to protect from insects), etc.

Figure 5:
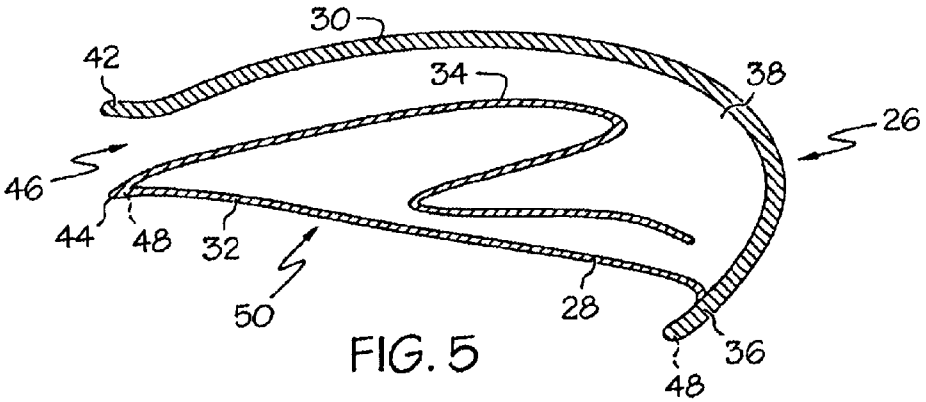
FIG. 5 is a side cross section of the boot of FIG. 2.

As best shown in FIGS. 4–6, the boot 26 may be coupled to the infant seat 10 such that the cover 34 can be generally received within the pocket 38 and is movable between a retracted position (FIGS. 3 and 5) wherein the cover 34 is generally located inside the pocket 38 and an extended position (FIGS. 4 and 6) wherein the cover 34 is generally or at least partially located outside of the pocket 38. The cover 34 may be retained or stored in its retracted position inside the pocket 38. When additional protection or heat insulation is desired for the occupant of the seat, the cover 34 can be moved to its extended position by pulling the cover 34 out of the pocket 38 and locating the cover 34 adjacent to the seat back 14 such that the cover 34 covers the torso or upper torso of the occupant 60 (FIG. 4).

As shown in FIGS. 4 and 6, after the boot 26 is coupled to the infant seat 10 and the cover 34 is moved to its extended position, the cover 34 may be able to be positioned such that it covers the majority of the body of the occupant 60. In this manner, the boot 26 and cover 34 may act to insulate and keep the occupant warm. The cover 34 may be sized or arranged to cover only a portion (i.e., the torso or upper torso), or the entirety of (i.e., the torso and head), an occupant 60 when in its extended position. In contrast, when the cover 34 is not desired to be used, the cover 34 can be stored in the pocket 38, as shown in FIGS. 3 and 5.

The boot 26 may be located on the infant carrier with the mouth 46 facing the seat back 14 (in which case a shorter cover 34 may be used), facing away from the seat back 14 (which enables the cover 34 to be easily accessed by an adult) or in some other orientation. Furthermore, the boot 26 need not necessarily include the pocket 38. Instead, the cover 34 may be able to be maintained in its retracted position by being coupled to the main portion 28 (for example, the underside of the main portion 28) by a variety of means or methods, including but not limited to hook and loop fastening systems, buttons, snaps, clasps, straps, brackets, clips, and the like. In this case, the cover 34 may be considered to be received "in" the main portion 28 when the cover 34 is coupled to the underside of the main portion 28 (i.e., in this case, the cover 34 may be located in the outer perimeter or "footprint" of the main portion 28).

Having described the invention in detail and by reference to the preferred embodiments, it will be apparent that modifications and variations thereof are possible without departing from the scope of the invention.

What is claimed is:

1. An infant or child seat boot comprising:

a main portion shaped to be removably coupled to a seat bottom of an infant or child seat to define a space therebetween for receiving legs of an occupant, said main portion shaped to extend over and around said seat bottom and sized only to cover said legs and a lower torso of said occupant; and a cover movable between a retracted position wherein said cover is generally received in said main portion and an extended position wherein said cover generally extends outwardly from said main portion and wherein said cover is shaped to cover only an upper torso of said occupant and not a head of said occupant.

2. The boot of claim 1 wherein said cover is coupled to said main portion.

3. The boot of claim 1 wherein said main portion includes a pocket which can receive said cover therein when said cover is in said retracted position.

4. The boot of claim 3 wherein said main portion includes a top portion and a bottom portion which are coupled together to form said pocket, and wherein said top and bottom portions are not coupled together along an open edge to define a mouth of said pocket.

5. The boot of claim 1 further comprising means for releasably coupling said boot to said infant or child seat, said coupling means being located on said main portion.

6. The boot of claim 1 wherein said main portion includes a lower opening shaped and sized to receive at least a portion of said infant or child seat therein to removably couple said boot to said infant or child seat.

7. The boot of claim 6 wherein said main portion includes elastic stitching located around the periphery of said lower opening such that the size of said lower opening may be varied.

8. An infant or child seat boot comprising:

a main portion shaped to be removably coupled to a seat bottom of an infant or child seat to define a space therebetween for receiving legs of an occupant, said main portion including a pocket for receiving a cover therein, and a mouth for providing access to said pocket wherein said main portion is shaped to extend over and around said seat bottom and sized only to cover said legs and a lower torso of said occupant, wherein said cover is shaped to cover only an upper torso of said occupant and not a head of said occupant and wherein said main portion includes a lower opening, said lower opening being shaped and sized to receive at least a portion of said child or infant seat therein to removably couple said boot to said child or infant seat.

9. The boot of claim 8 wherein said main portion includes elastic stitching located around the periphery of said lower opening such that the size of said lower opening may be varied.

10. An infant or child seat boot for use with a seat having a seat back and a seat bottom comprising:

a main portion shaped to be removably coupled to said seat bottom and having a pocket wherein said main portion is shaped to extend over and around said seat bottom and is sized only to cover said legs and a lower torso of an occupant; and a cover coupled to main portion and being repositionable between an extended position and a retracted position and wherein said cover is shaped to cover only an upper torso of said occupant and not a head of said occupant and further wherein said cover is located generally adjacent to said seat back in said extended position and said cover is generally located in said pocket and is not located generally adjacent to said seat back in said retracted position.

11. The boot of claim 10 wherein said main portion includes a top portion and a bottom portion which are directly coupled together along at least one common edge to form said pocket, and wherein said top and bottom portions are not coupled together along an open edge to define a mouth of said pocket.

12. The boot of claim 10 wherein said main portion includes a lower opening, said lower Hung being shaped and Sided to receive at least a portion of an infant or child se therein to removably couple said boot to said infant or child seat.

13. The boot of claim 12 wherein said main portion includes elastic stitching located around the periphery of said lower opening such that the size of said lower opening may be varied.

14. A boot comprising:

a main portion including a pocket and an elastic material extending at least partially around the perimeter of said main portion wherein said main portion is shaped to extend over and around a seat bottom and sized only to cover legs and a lower torso of a seat occupant; and a cover coupled to said main portion and being movable between a retracted position wherein said cover is generally received in said pocket and an extended position wherein said cover is located generally outside of said pocket and wherein said cover is shaped to cover only an upper torso of said occupant and not a head of said occupant.

15. The boot of claim 14 wherein said main portion includes a top portion and a bottom portion which are directly coupled together along at least one common edge to form said pocket, and wherein said top and bottom portions are not coupled together along an open edge to define a mouth of said pocket.

16. The boot of claim 15 wherein said main portion includes a lower opening and wherein said elastic material is located around the periphery of said lower opening such that the size of said lower opening may be varied.

17. An infant or child seat boot comprising:

a main portion shaped to be removably coupled to a seat bottom of an infant or child seat to define a space therebetween for receiving legs of an occupant, said main portion including a top portion and a bottom portion which are coupled together to form a pocket, said main portion including a lower opening and an elastic material extending substantially around a perimeter of said lower opening to enable said main portion to be removably coupled to said seat bottom wherein said main portion is shaped to extend over and around said meat bottom and is sized only to cover said legs and a lower torso of said occupant; and a cover coupled to said main portion and being movable between a retracted position wherein said cover is generally received in said pocket and an extended position wherein said cover is generally not received in said pocket an wherein said cover is shaped to cover only an upper torso of said occupant and not a head of said occupant.

* * * * *